US007264010B2

(12) United States Patent
Husain et al.

(10) Patent No.: US 7,264,010 B2
(45) Date of Patent: Sep. 4, 2007

(54) DETERGENT, CLEANING METHOD AND CLEANING APPARATUS

(75) Inventors: Mohd Nazri Bin Husain, Selangor Darul Ehsan (MY); Affendi Bin Mohamed Zain, Selangor Darul Ehsan (MY)

(73) Assignee: Matsushita Electric Industrial Co., Ltd., Osaka (JP)

( * ) Notice: Subject to any disclaimer, the term of this patent is extended or adjusted under 35 U.S.C. 154(b) by 61 days.

(21) Appl. No.: 11/136,916

(22) Filed: May 25, 2005

(65) Prior Publication Data

US 2005/0239668 A1 Oct. 27, 2005

Related U.S. Application Data

(62) Division of application No. 10/722,722, filed on Nov. 26, 2003, now Pat. No. 6,929,703.

(30) Foreign Application Priority Data

Nov. 30, 2002 (MY) ..... PI20024501

(51) Int. Cl.

| | |
|---|---|
| ***B08B 3/00*** | (2006.01) |
| ***D06F 31/00*** | (2006.01) |
| ***D06F 35/00*** | (2006.01) |
| ***C11D 17/00*** | (2006.01) |

(52) U.S. Cl. ..... 134/201; 134/34; 68/9; 68/11; 68/12.13; 68/17 R; 68/27; 510/416

(58) Field of Classification Search ..... 68/12.13, 68/18 R, 18 F, 17 R, 9, 11, 27; 134/201; 510/416

See application file for complete search history.

(56) References Cited

U.S. PATENT DOCUMENTS

| | | | | |
|---|---|---|---|---|
| 3,166,444 | A | 1/1965 | Ehren et al. | |
| 3,242,093 | A | 3/1966 | Compton | |
| 3,385,735 | A | 5/1968 | Brabrand et al. | |
| 3,544,365 | A | 12/1970 | McCormick | |
| 3,993,575 | A | 11/1976 | Howanitz et al. | |
| 5,909,742 | A | 6/1999 | Ouyang et al. | |
| 5,981,454 | A * | 11/1999 | Small | 510/175 |
| 5,989,353 | A * | 11/1999 | Skee et al. | 134/2 |
| 6,077,501 | A * | 6/2000 | Sickora et al. | 424/49 |
| 6,341,612 | B1 | 1/2002 | Duckett et al. | |
| 6,662,813 | B1 | 12/2003 | Murch et al. | |
| 2002/0094939 | A1 * | 7/2002 | Sachdev et al. | 510/176 |
| 2003/0041885 | A1 | 3/2003 | Held, III | |
| 2004/0014692 | A1 | 1/2004 | Bagchi et al. | |

FOREIGN PATENT DOCUMENTS

| | | |
|---|---|---|
| JP | 2000-74731 | 3/2000 |

* cited by examiner

*Primary Examiner*—Michael Barr
*Assistant Examiner*—Rita R. Patel
(74) *Attorney, Agent, or Firm*—RatnerPrestia

(57) ABSTRACT

An environmental friendly cleaning method and a cleaning apparatus are disclosed. The method comprising cleaning an article using a composition comprising material extracted from the fruit of a plant, such as a plant of the genus *Garcinia*, for example the fruit of the plant *Garcinia atroviridis*.

13 Claims, 3 Drawing Sheets

DETERGENT, CLEANING METHOD AND CLEANING APPARATUS

This application is a divisional of U.S. patent application Ser. No. 10/722,722, filed Nov. 26, 2003 now U.S. Pat. No. 6,929,703, the contents of which are incorporated herein by reference.

BACKGROUND OF THE INVENTION

1. Field of the Invention

The present invention relates to cleaning using a detergent whose ingredient is a fruit of a natural plant.

2. Background Art

An article (e.g., a mechanical component, device or souvenir) whose part or whole is made of ceramic, copper, brass, stainless, aluminum or the like is conventionally cleaned using a chemical agent.

For example, Japanese Patent Unexamined Publication 2000-74731 discloses that when an Acceleration Responding Switch formed of several constituent components is assembled, the housing, which is one of the constituent components, is cleaned with diluted hydrochloric acid before assembling. When an electric contact point of such a switch is soiled, fault of electrical continuity occurs, so that the switch can not normally work. In addition, when stains, oil spots or rust of the articles are stubborn, manual work using the chemical agent and using cloth, a sheet of sandpaper or a diamond file is frequently performed for cleaning.

However, the chemical agent used in the conventional cleaning sometimes adversely affects the environment. In addition, some of the chemical agents have acrid smell, so that from a safety standpoint, they are not preferable for an operator which engages in cleaning work.

SUMMARY OF THE INVENTION

The present invention is directed to solve the problems discussed above, and it is an object of the invention to provide an environmental friendly cleaning method and detergent. To achieve the object, the cleaning method of the present invention uses the detergent whose ingredient is a natural plant. In addition, an article is immersed into the detergent, or the detergent is sprayed on the article.

Additional objects and advantages of the present invention will be apparent from the following detailed description of preferred embodiments thereof, which are best understood with reference to the accompanying drawings.

DETAILED DESCRIPTION OF THE INVENTION

Using a detergent of this invention, an environmental friendly cleaning method can be provided. A boiling condition that a fruit of a natural plant is boiled can be controlled, whereby the detergent can be produced at a certain pH value. A filter for filtering the detergent after cleaning an article can be provided, so that the detergent can be recycled. In addition, an effluents-treating section for neutralizing or diluting the detergent after cleaning an article can be provided, thereby draining effluents with a small environmental impact. The environmental impact means an impact applied by human activity against an environment, and is in danger of a cause of an obstacle to preserve the environment.

Features of the detergent of this invention are described hereinafter. The detergent is made of a fruit of a natural plant, and environmental friendly. An ingredient of the natural plant is eluted for a short time by boiling a fruit of citrus fruit base so as to produce the detergent. In addition, the detergent having a certain pH value can be easily obtained by controlling a boiling condition. Moreover, because the detergent is acid, a conventional cleaning condition for using an acid chemical agent can be used.

Among the natural plants, a *garcinia* is suitable for the environmental friendly detergent. A *garcinia* is a kind of citrus fruits, and a common plant in countries of the South Asia such as Malaysia, Cambodia or Thailand, so that it can be easily obtained. The fruit is strongly acid, but edible. A dried fruit of a *garcinia* can be also easily obtained. Besides, it is also strongly acid, edible and used for a seasoning. Extracted material from the *garcinia* is known as a medical supply, and its ingredient includes citric acids such as hydroxyl citric acid (HCA), malic acids or ascorbic acids.

Exemplary embodiments of the present invention are demonstrated hereinafter.

(Production of the Detergent)

A producing method of the detergent of the present invention is described hereinafter with reference to FIG. 1.

First, the dried fruit of *Garcinia Atroviridis*, which is an ingredient of detergent 10, is cleaned with water before a producing process.

Figure 1:
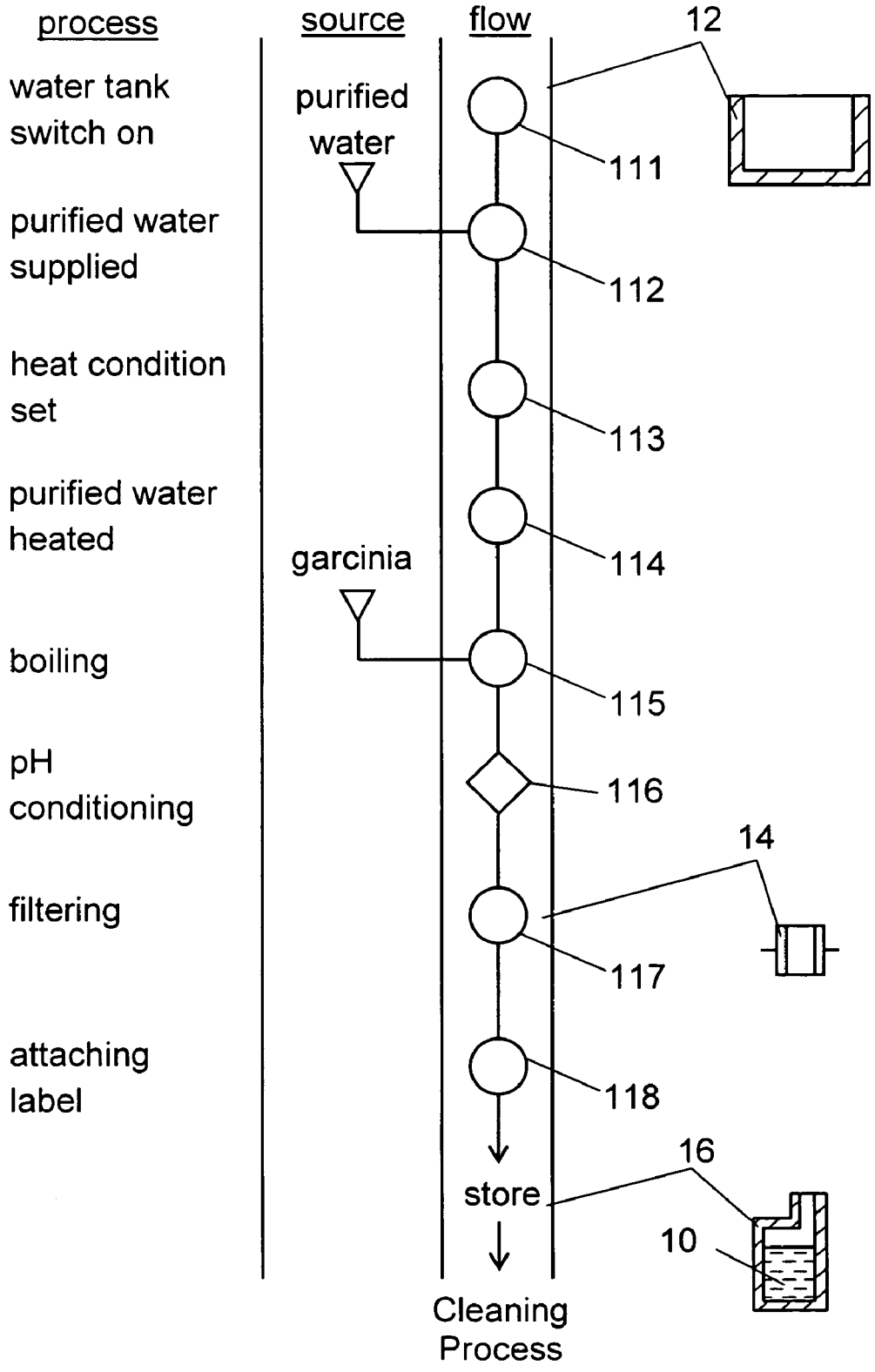
FIG. 1 is a schematic view showing a producing process of a detergent in accordance with an exemplary embodiment of the present invention.

Second, as shown in FIG. 1, a power source of water tank 12 is turned on in preparatory process 111. Purified water is supplied into water tank 12 having a heater in water supplying process 112. A heat condition is set in heat-condition-setting process 113, and the purified water in water-tank 12 is heated in heating process 114.

Third, the dried fruit of *Garcinia Atroviridis* is thrown into water tank 12 and boiled in boiling process 115. The dried fruit of *Garcinia Atroviridis*, which is the ingredient of detergent 10, may be put in water tank 12 in advance. In that case, for example, a certain amount of the dried fruits are put in the water tank in the preparatory process. According to results of experiments, a ratio of the purified water to the dried fruit of *Garcinia Atroviridis* is preferably 22 liter to 10 grams.

In the present embodiment, detergent 10 is demonstrated to be produced from the dried fruit of *Garcinia Atroviridis*, however, detergent 10 may be produced from a raw fruit thereof.

In boiling process 115, the dried fruit of *Garcinia Atroviridis* is boiled for a certain time, whereby a solution is produced by eluting an ingredient of the fruit. The ingredient of the fruit is eluted for a short time by boiling. In this boiling process, when the solution indicates a certain pH value, the boiling work is finished. In the present embodiment, the boiling work is executed for approximately 20 minutes so as to obtain the solution of pH 2–pH 3.

If the solution does not indicate pH 2–pH 3 in boiling process 115, the pH is conditioned at conditioning process 116. If the solution is lower than pH 2, purified water is added, and if the solution is higher than pH 3, the dried fruit of *Garcinia Atroviridis* is added.

In filtering process 117 shown in FIG. 1, the solution is filtered with filter 14, so that the detergent made of *Garcinia Atroviridis* solution is produced.

As discussed above, detergent 10 is produced by eluting the fruit of *Garcinia Atroviridis* which is a natural plant, so that if it is touched with empty hands or drunken, it does not adversely affect a human body, and its environmental impact is small.

In label attaching process 118, the produced detergent 10 is poured into vessel 16 for storing, where a label, on which a producing date, a pH value or the like is noted, is attached on vessel 16. Stored detergent 10 is taken out when an article is cleaned.

Commercial formulation extracted from *Garcinia Atroviridis* can be also used. In that case, the extracted material is put into purified water and dissolved to produce water solution which is used as detergent 10. The detergent is also stored into the vessel where a label on which necessary items are noted is attached.

A pH value of the detergent preferably ranges from 1 to 5 for cleaning components. Articles such as electronic components are generally cleaned in a state where they are accommodated in a pallet. If the pallet is made of metal, the detergent of pH 1–pH 5 can be used. However, if the pallet is made of thermoplastic or the like and the pH value of the detergent is too much low, the pallet may be deteriorated. Therefore, the detergent is desirable to be conditioned from pH 2 to pH 3 for the thermoplastic pallet. Accordingly, when the components are accommodated in the pallet and cleaned therewith, the detergent of pH 2–pH 3 is suitable.

(Cleaning Method of Articles)

The cleaning method of the present invention is described hereinafter with reference to FIG. 2.

Figure 2:
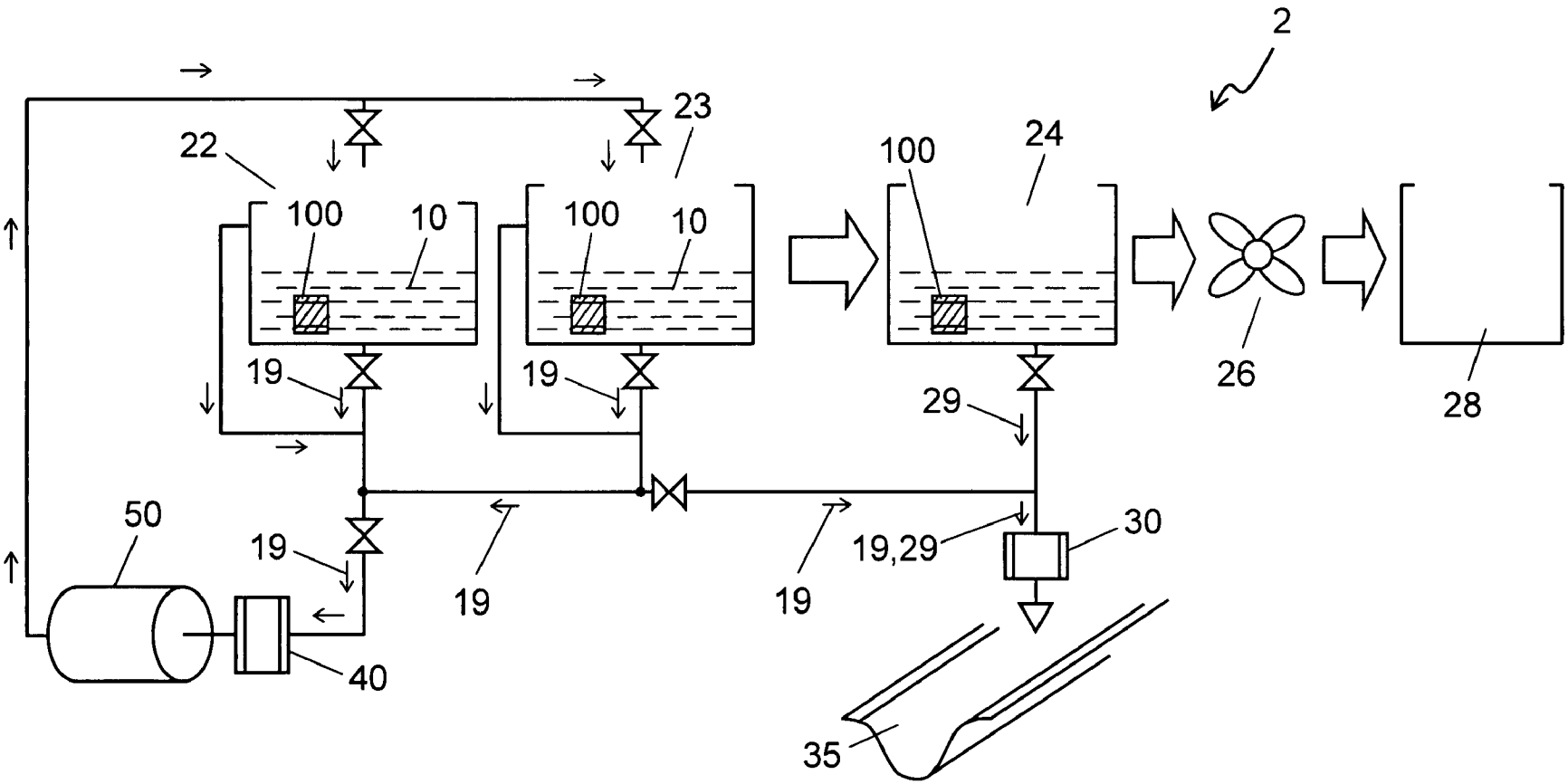
FIG. 2 is a schematic view showing a cleaning operation in accordance with the exemplary embodiment of the present invention.

Detergent 10 is poured into cleaning section 22 of cleaning apparatus 2 shown in FIG. 2. Cleaning section 22 is an ultrasonic cleaning tank having an ultrasonic cleaning mechanism and a function for heating detergent 10. The pH value of detergent 10 can be changed according to a desirable cleaning level, a kind or an amount of articles. In this embodiment, the articles are accommodated in the pallet and cleaned therewith, where the detergent is conditioned from pH 2 to pH 3.

Article 100 which is an object of cleaning is immersed into detergent 10 and cleaned. Cleaning time or a temperature of detergent 10 is set according to a desirable cleaning level of article 100. Ultrasonic cleaning can shorten the cleaning time. A frequency of the ultrasonic cleaning is set according to a desirable cleaning level, a kind or an amount of articles.

Cleaning apparatus 2 shown in FIG. 2 has cleaning section 22 and cleaning section 23, both of which have similar functions. An identical or a different cleaning condition can be applied in cleaning sections 22 and 23. When a large amount of articles are cleaned at once in the same condition, the same cleaning condition is set up in cleaning sections 22 and 23. When preliminary cleaning and main cleaning are required, cleaning conditions of cleaning section 22 and cleaning section 23 are respectively set up according to the preliminary cleaning and main cleaning. Because a certain pH value of detergent 10 has to be kept in the preliminary and main cleaning processes, a pH value of detergent 10 is monitored. If the pH value deviates from the certain pH value, stored detergent 10 or purified water is supplied for controlling the pH value.

Next, article 100 after cleaning is taken out of cleaning section 22 and cleaning section 23, and moved to rinsing section 24. Then, detergent 10 on article 100 is removed by cleaning article 100 with purified water at rinsing section 24.

After that, article 100 after cleaning is moved from rinsing section 24 to drying section 26. Drying section 26 has an air blower, and dries water on article 100. Then, article 100 is moved into heater 28 for heating, and completely dried.

Used detergent 19, which has remained after cleaning at cleaning sections 22 and 23, is neutralized and becomes pH 7 or diluted at effluents-treating section 30. Then used detergent 19 is drained into ditch 35 such as a drainage ditch or a river. Similarly, liquid 29 which has remained after cleaning at rinsing section 24 is neutralized or diluted at effluents-treating section 30, and then drained. Using this method, an environmental impact caused by the detergent is more reduced.

Used detergent 19, which has remained at cleaning sections 22 and 23, can be recycled. In this case, used detergent 19 is filtered with filter 40, returned to cleaning section 22 with pump 50 or the like and used in a cleaning process again.

(Cleaning Apparatus)

The cleaning apparatus of the present invention is described hereinafter with reference to FIG. 3.

Figure 3:
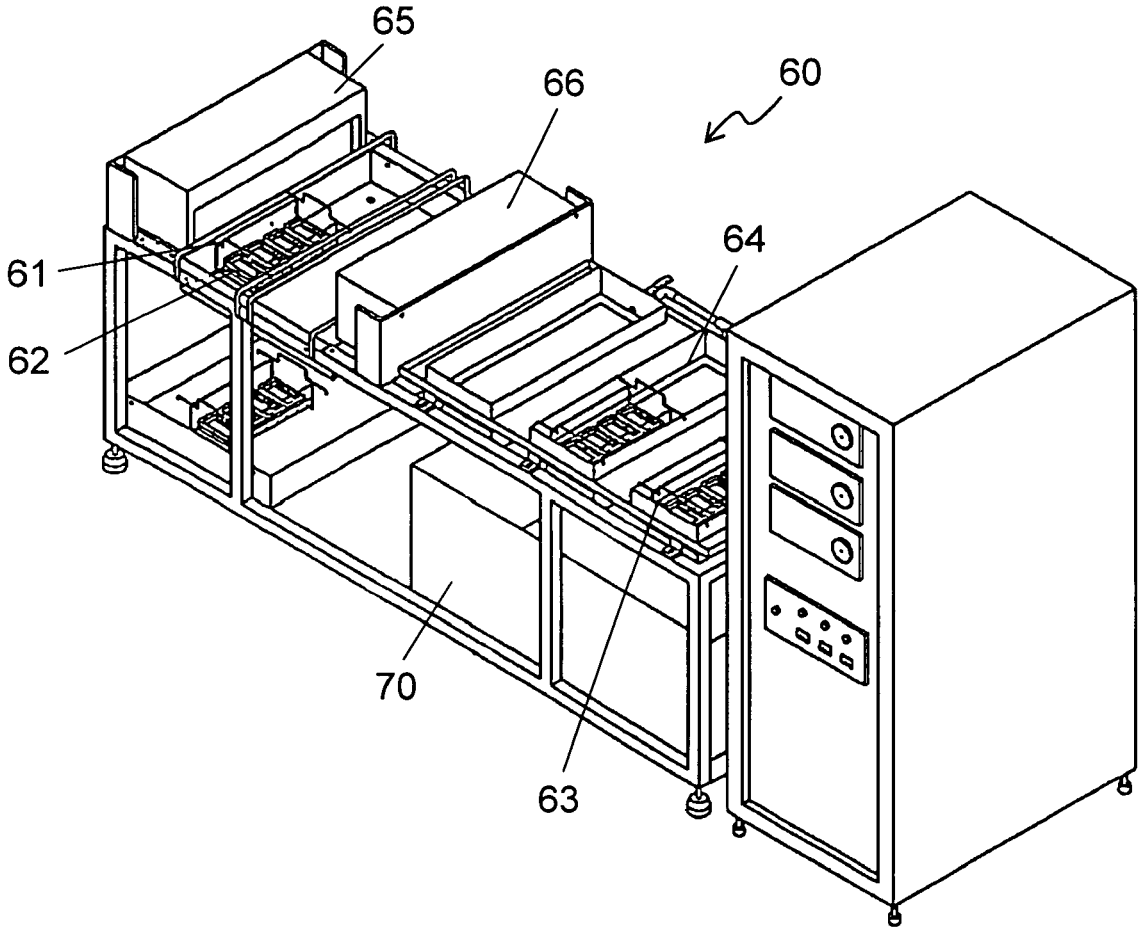
FIG. 3 is a perspective view showing a cleaning apparatus in accordance with the exemplary embodiment of the present invention.

Cleaning apparatus 60 in FIG. 3 has the same structure as cleaning apparatus 2 in FIG. 2. Cleaning tank 63 corresponds to cleaning section 22 or cleaning section 23, and rinsing tank 64 corresponds to rinsing section 24. Air blower 65 corresponds to drying section 26, and heater 66 corresponds to heater 28. Pallet 62 corresponds to article 100.

Pallet 62 is used for holding an electronic component in a manufacturing process of an electronic component. A cleaning level of pallet 62 greatly affects non-defective percentages of the electronic component. The cleaning level indicates how cleanly the pallet 62 is cleaned.

Pallet 62 is held by jig 61, and immersed in the detergent poured into cleaning tank 63 for cleaning. After cleaning, pallet 62 together with jig 61 is immersed in purified water poured into rinsing tank 64 for cleaning. Cleaned pallet 62 together with jig 61 is dried with air blower 65 and heater 66.

In this embodiment, the article is immersed in the detergent for cleaning, however, the detergent can be sprayed onto the article for cleaning. In this case, some articles are cleaned by spraying the detergent at one time. Other articles are cleaned by showering the detergent sequentially according to a desirable cleaning level. In addition, according to this embodiment, the article after cleaning is immersed in purified water for rinsing. However, the article can be rinsed by directly spraying water onto the article.

In this embodiment, the fruit of *Garcinia Atroviridis* is used as a *garcinia*, however, a fruit of other *garcinias* such as *Garcinia Cambogia* or *Garcinia Mangostana* can be used. By using extracted material from a fruit of these garcinias as a detergent, surface tension of the detergent decreases, so that the detergent can thoroughly penetrate an article having a complicated shape. In addition, anti-oxidant action or the like of this fruit can generate an advantageous effect as a detergent.

As discussed above, the detergent, cleaning method and cleaning apparatus of this invention can be used for cleaning an article whose part or whole is made of ceramic, copper, brass, stainless, steel, aluminum, plastics or the like. As a result, an environmental impact caused by the detergent can be reduced.

It will be obvious to those skilled in the art that various changes may be made in the above-described embodiments of the present invention. However, the scope on the present invention should be determined by the following claims.

What is claimed is:

1. A cleaning apparatus for cleaning an article, the apparatus comprising:

a detergent solution preparing section for preparing a detergent solution, the detergent solution preparing section comprising:

an extraction section for extracting a detergent component from a fruit of a natural plant, and a pH value controller for controlling a pH value of the solution extracted from the fruit, a filter for filtering the solution, and a cleaning section, the cleaning section comprising the detergent solution that comprises the material extracted from the fruit of the natural plant wherein the natural plant is a plant of the genus *Garcinia*, and wherein the cleaning section is structured to perform one of immersing the article in the detergent solution and spraying the detergent solution onto the article.

2. The cleaning apparatus of claim 1, wherein the detergent solution is produced by boiling the fruit of the natural plant.

3. The cleaning apparatus of claim 1, wherein the detergent solution is acidic.

4. The cleaning apparatus of claim 1, wherein the natural plant is one of citrus fruits.

5. The cleaning apparatus of claim 1, wherein the cleaning section comprises: a cleaning tank for immersing the article in the detergent solution.

6. The cleaning apparatus of claim 5, wherein the cleaning tank has an ultrasonic cleaning mechanism.

7. The cleaning apparatus of claim 1 further comprising: a rinsing section for cleaning the article, which has been cleaned at the cleaning section, with purified water.

8. The cleaning apparatus of claim 7 further comprising a drying section.

9. The cleaning apparatus of claim 1 further comprising: a filtering section for filtering the detergent solution which has been used.

10. The cleaning apparatus of claim 1 further comprising: an effluents-treating section which is structured to perform one of neutralizing and diluting the detergent solution which has been used.

11. The cleaning apparatus of claim 1, wherein the article comprises ceramic, copper, brass, stainless steel, aluminum, or plastic.

12. The cleaning apparatus of claim 1, wherein the natural plant is *Garcinia atroviridis*.

13. The cleaning apparatus of claim 10, wherein the natural plant is *Garcinia atroviridis*.

* * * * *